US006027016A

United States Patent [19]

Ljungström et al.

[11] Patent Number: 6,027,016

[45] Date of Patent: Feb. 22, 2000

[54] BEVELED EDGE CARTON AND BLANK THEREFOR

[75] Inventors: Tommy Bo-Goran Ljungström, Höör, Sweden; Russell Stacy-Ryan, Chicago, Ill.

[73] Assignee: Tetra Laval Holdings & Finance, SA, Pully, Switzerland

[21] Appl. No.: 09/005,804

[22] Filed: Jan. 12, 1998

Related U.S. Application Data

[63] Continuation-in-part of application No. 08/620,698, Mar. 21, 1996, Pat. No. 5,738,272.

[51] Int. Cl.[7] ..... B65D 5/02

[52] U.S. Cl. ..... 229/109; 229/116.1; 229/920; D9/432

[58] Field of Search ..... 229/109, 116.1, 229/117.35, 125.15, 125.42, 137, 138, 920; D9/430, 432, 433

[56] References Cited

U.S. PATENT DOCUMENTS

| | | | |
|---|---|---|---|
| D. 244,993 | 7/1977 | Drysdale | D9/432 |
| 2,050,894 | 8/1936 | Paige | 229/116.1 |
| 3,126,143 | 3/1964 | Hagan | 229/920 |
| 4,076,147 | 2/1978 | Schmit | 229/117.35 |
| 4,714,164 | 12/1987 | Bachner | 229/920 |
| 4,798,296 | 1/1989 | Lagerstedt et al. | 229/125.42 |
| 5,636,785 | 6/1997 | Kalberer et al. | 229/125.15 |
| 5,704,541 | 1/1998 | Mogard | 229/125.15 |
| 5,738,272 | 4/1998 | Anchor et al. | 229/109 |

FOREIGN PATENT DOCUMENTS

| | | | |
|---|---|---|---|
| 276893 | 8/1988 | European Pat. Off. | 229/138 |
| 277673 | 8/1988 | European Pat. Off. | 229/138 |

*Primary Examiner*—Gary E. Elkins

[57] ABSTRACT

The present invention is a carton having side panels which intersect at beveled edges to provide greater grip stiffness and reduced surface area to volume, and a blank therefor. The blank has vertical score lines which extend along the entire length of the blank at least two of the edges in order to assist in the fabrication of the carton on a form, fill and seal packaging machine. The carton may have a rectangular cross-section, a square cross-section or the like. The carton may have a fitment attached thereto for accessing the product contained therein. The carton may have an over-folded bottom for protection against leakage and wicking.

18 Claims, 14 Drawing Sheets

BEVELED EDGE CARTON AND BLANK THEREFOR

CROSS REFERENCES TO RELATED APPLICATIONS

The present application is a Continuation-In-Part Application of application Ser. No. 08/620,986, U.S. Pat. No. 5,738,272 which was filed on Mar. 21, 1996 and which is hereby incorporated by reference.

STATEMENT REGARDING FEDERALLY SPONSORED RESEARCH OR DEVELOPMENT

Not Applicable

BACKGROUND OF THE INVENTION

1. Field of the Invention

The present invention relates to a carton and corresponding carton blank. More specifically, the present invention relates to a gable top carton and blank therefor having a reduced surface area per unit volume of the carton when compared to conventional gable top carton configurations.

2. Description of the Related Art

Gable top cartons have been known for the better part of the twentieth century. Their characteristic simplicity and resealability have helped to sustain their popularity as containers for traditional liquid food products such as milk and juice, but in recent years they have been used for products ranging from ammunition to soups. Gable top cartons typically begin as generally rectangular carton blanks made of laminated paperboard or similar material. The carton blanks are provided with a number of creases to facilitate folding and forming the blank into a rectangular carton having the characteristic gable top.

When fully folded, filled and sealed, the gable top cartons include a gabled top structure that engages a plurality of side panels. Traditionally, each side panel is generally perpendicular to each adjacent side panel. The panels are each divided from one another by a single vertical score line extending the entire height of the sidewall. These side panels form the characteristic hollow rectangular body of the container and define the volume of product that a carton may hold.

In accordance with accepted design approaches, the design of a traditional gable top carton to accommodate a specified volume involves adjusting the dimensions of the four sidewalls defining the rectangular body that is to contain the specified volume. Very often, these product volume requirements are specified by the packager and selected from standard volumes that have been deemed accepted in the consumer market for the product (i.e., pint, quart, half gallon, gallon, half liter, liter, etc.). When this design approached is utilized, there exists a generally established relationship between the surface area of the carton blank and the carton volume. The surface area of the carton, and particularly the area of the four sidewalls constituting the bulk of the surface area, is thus generally fixed for a given container volume.

Additional end panel extensions and end panel shapes are often employed to assist in folding and sealing the traditional gable top cartons. These added extensions and shapes result in added carton surface area per unit volume of product.

The traditional approaches to gable top carton design have heretofore devoted little effort to optimizing the carton surface area per unit volume of product. Several reasons for this lack of effort include problems of fabrication of such a carton on a linear form, fill and seal packaging machine, the appearance of such a carton due to an increased number of crease lines and their placement on a carton, and gripability of such a carton.

BRIEF SUMMARY OF THE INVENTION

One aspect of the present invention is a carton having beveled edges at the intersection of it side panels. Another aspect of the present invention is a carton blank for fabrication into a carton having beveled edges. The carton blank has a series of score lines in order to fold and fabricate the carton on a form, fill and seal packaging machine.

It is a primary object of the present invention to provide a carton having a reduced surface area per volume.

It is an additional object of the present invention to provide a carton blank for a carton having a reduced surface area to volume.

It is an additional object of the present invention to provide a carton having a rectangular cross-section and beveled edges, and a blank therefor.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a perspective view of a preferred embodiment of a carton of the present invention;

Figure 1:
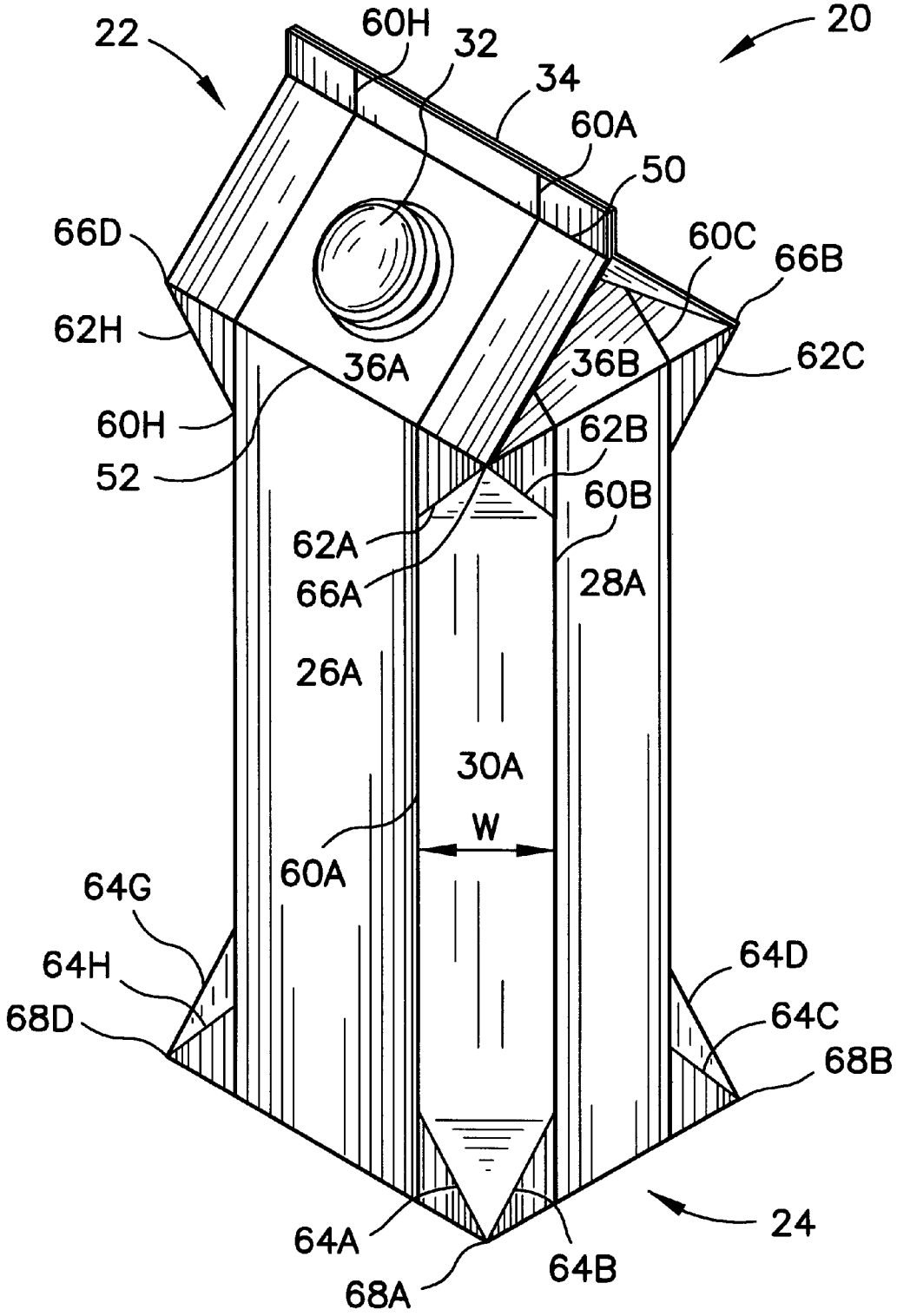
Figure 2:
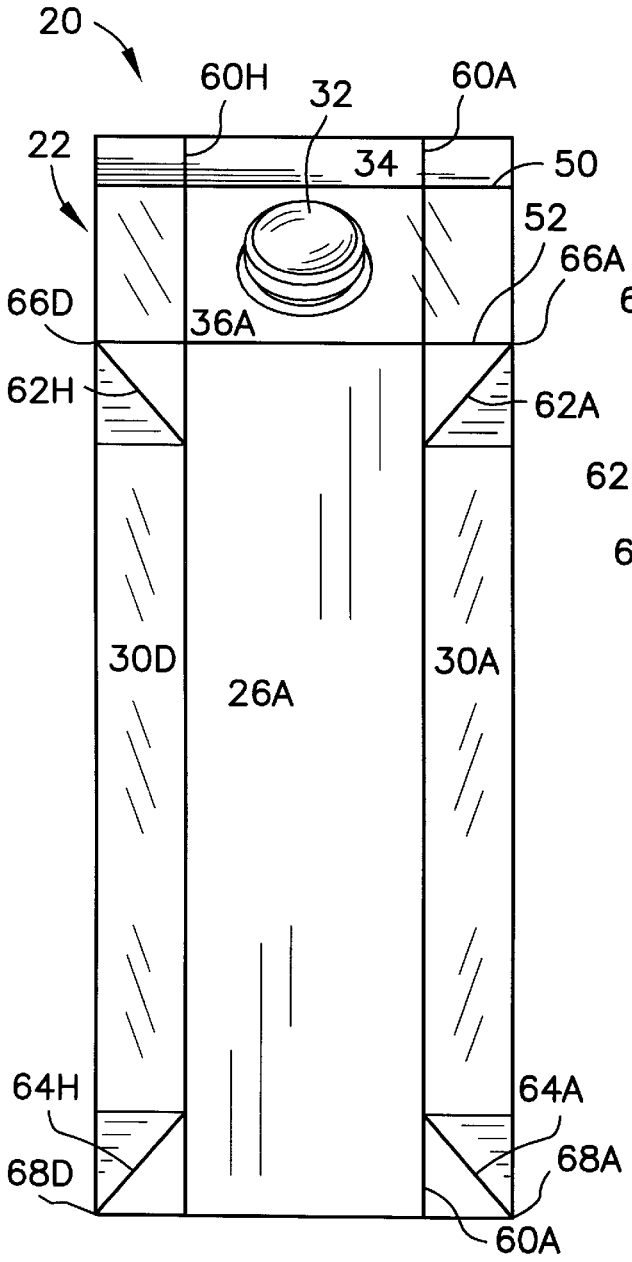
Figure 3:
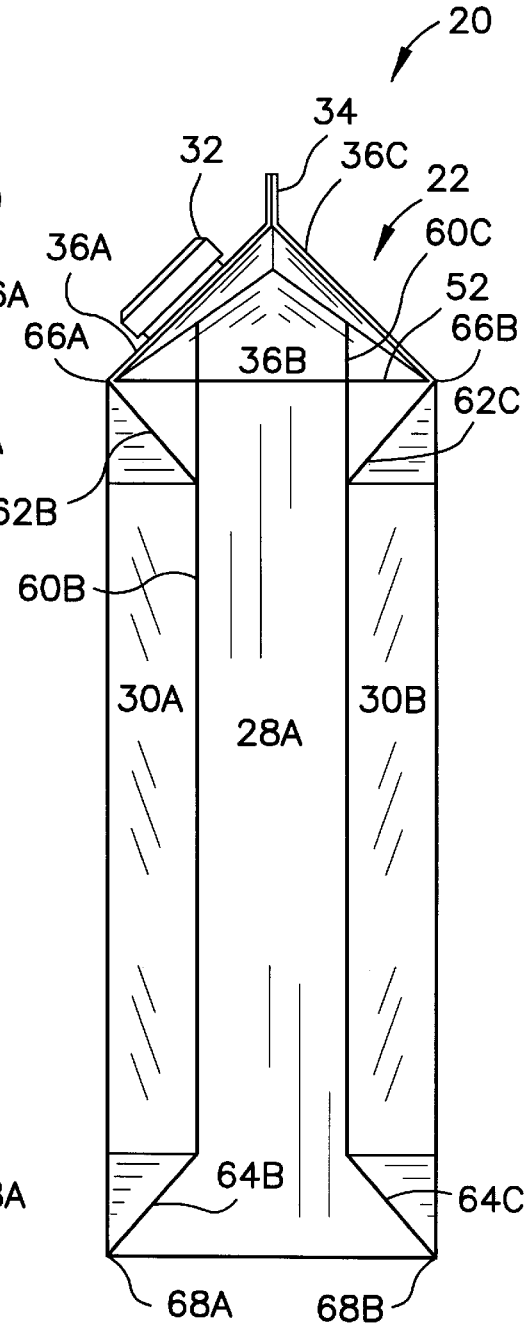
Figure 4:
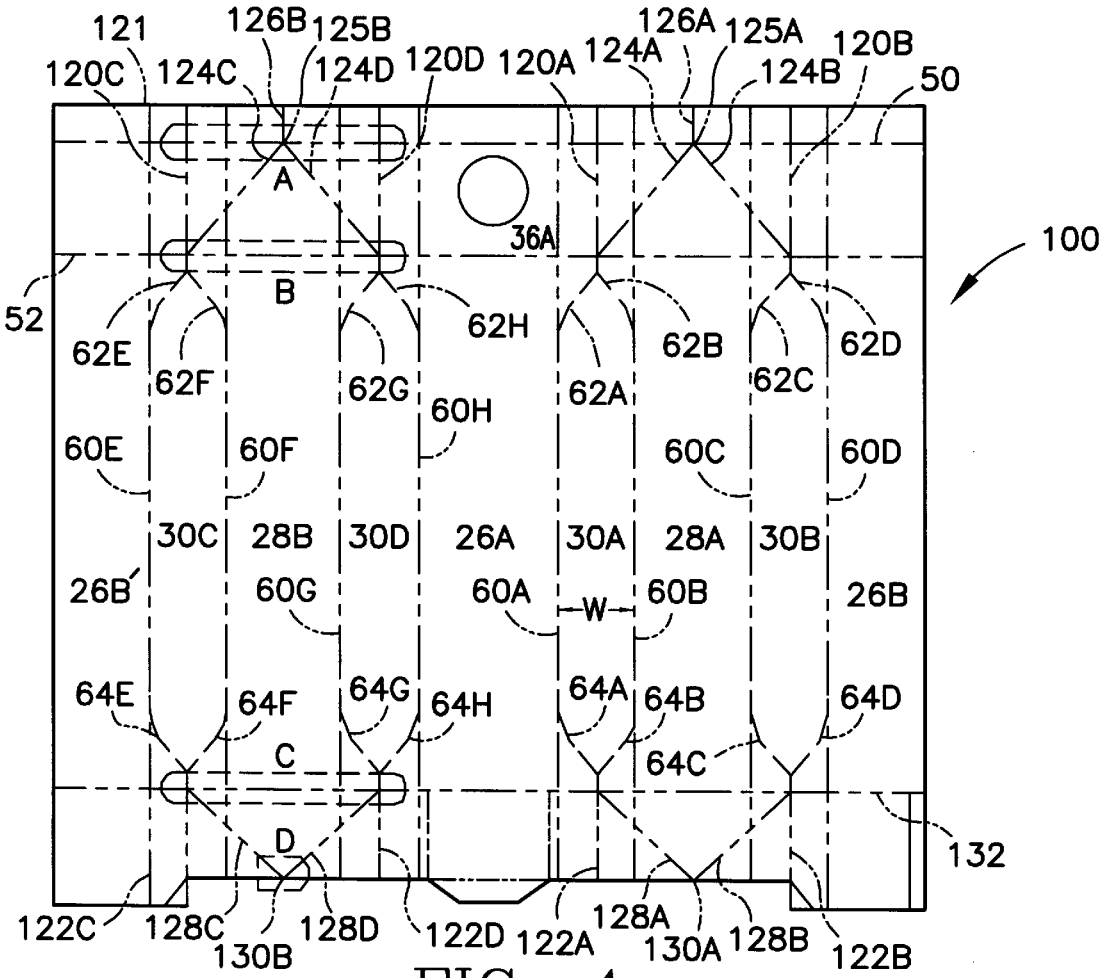
Figure 4A:
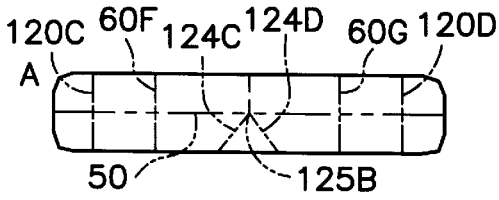
Figure 4C:
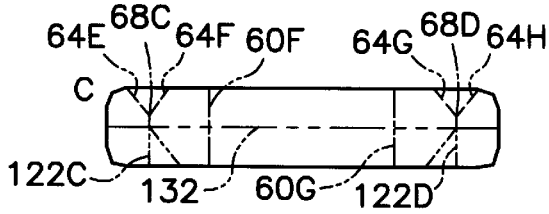
Figure 4B:
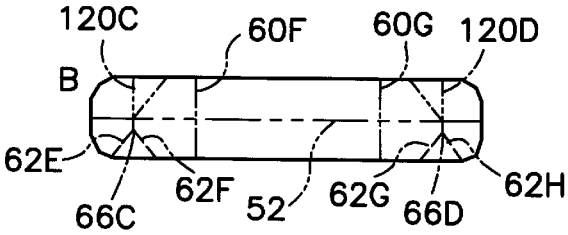
Figure 4D:
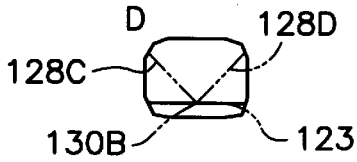
Figure 5:
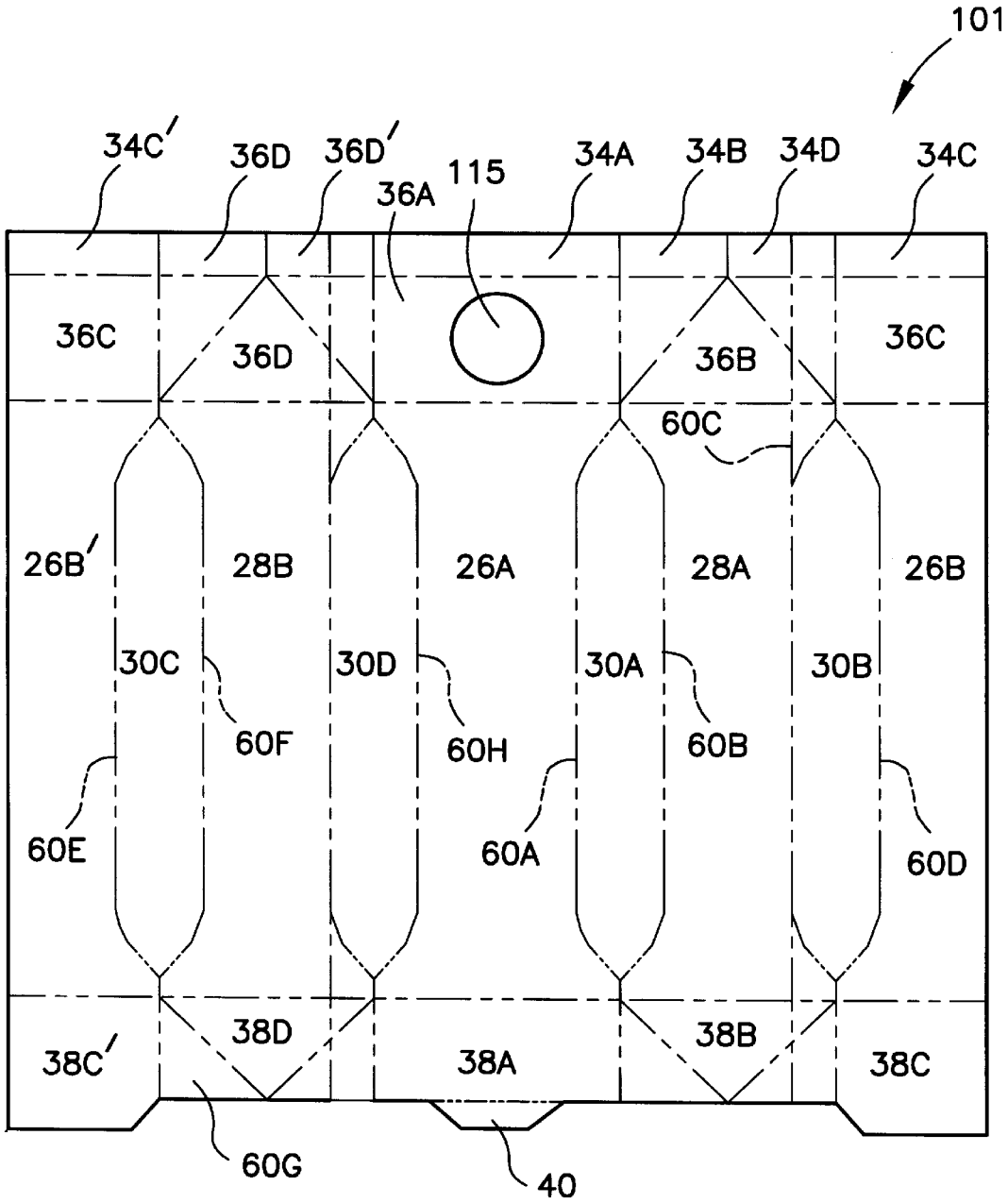
Figure 6:
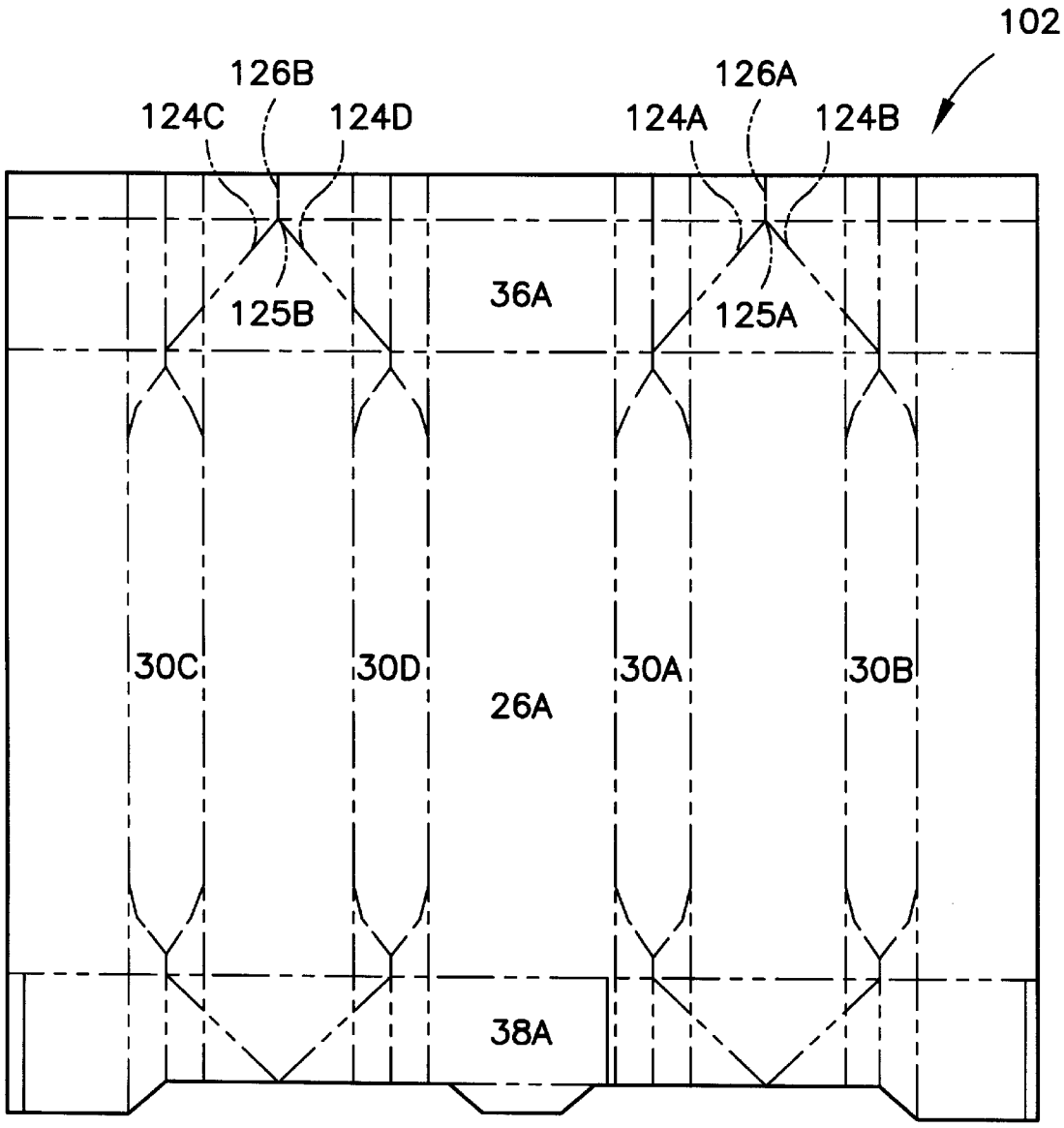
Figure 7:
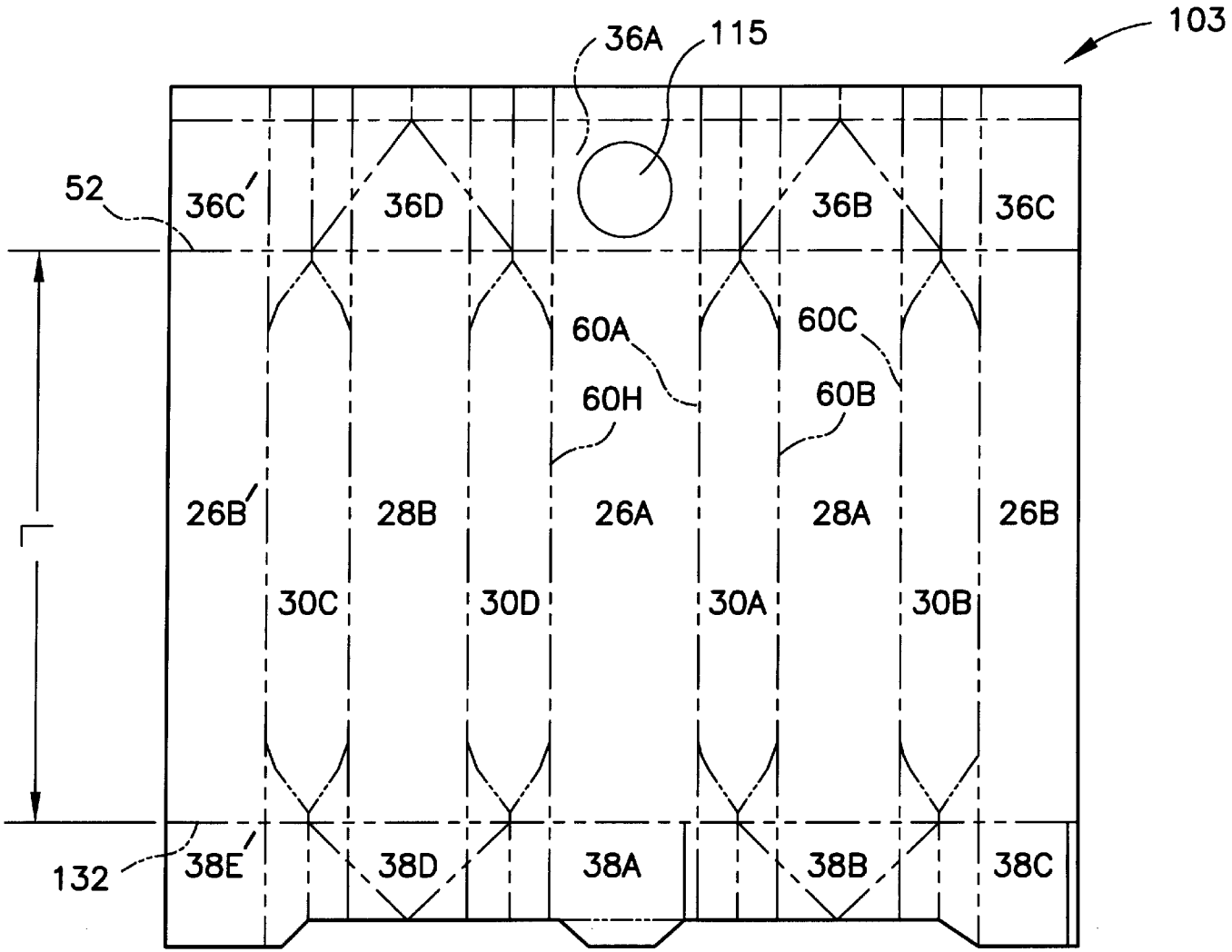
Figure 8:
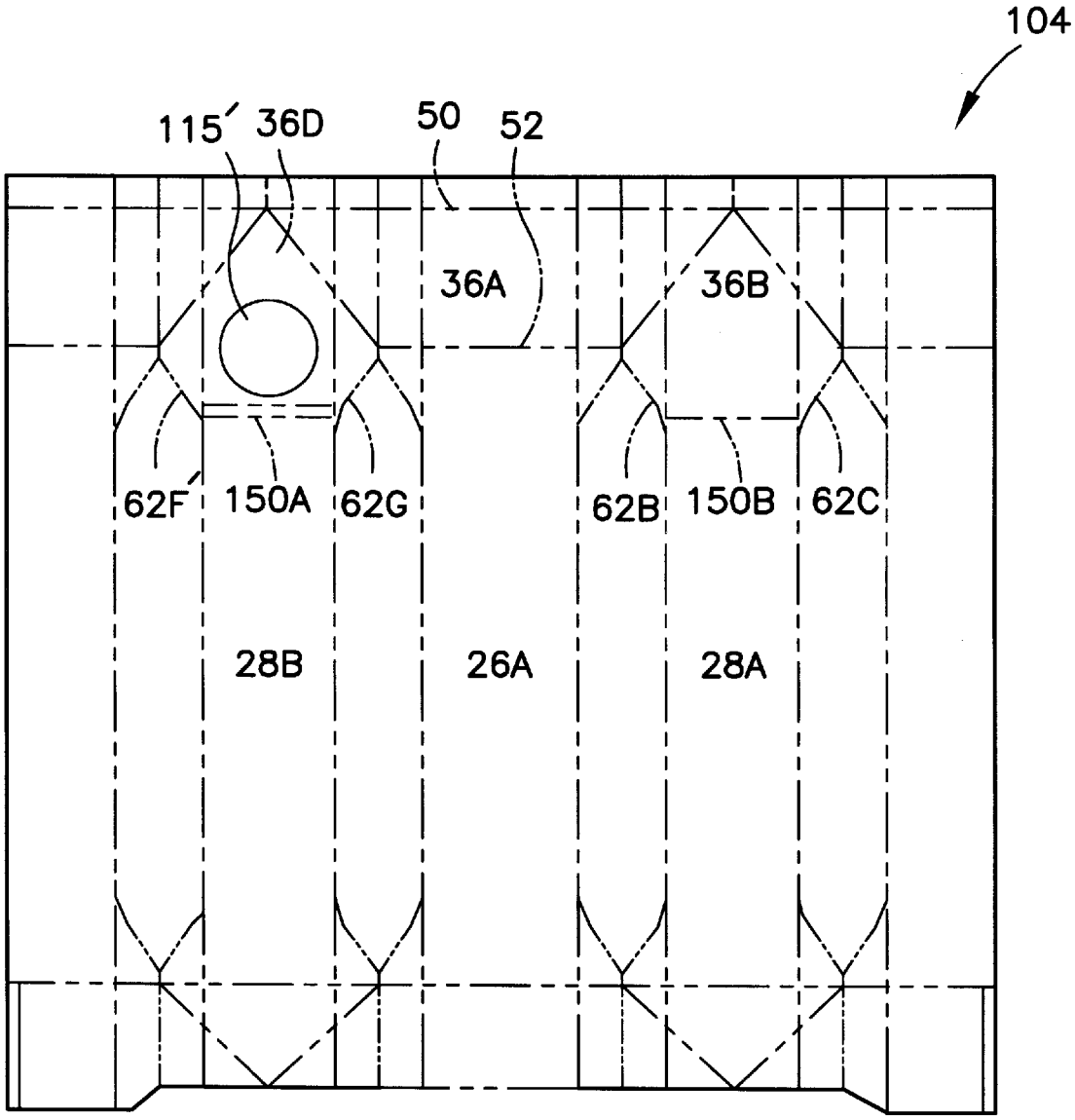
Figure 9:
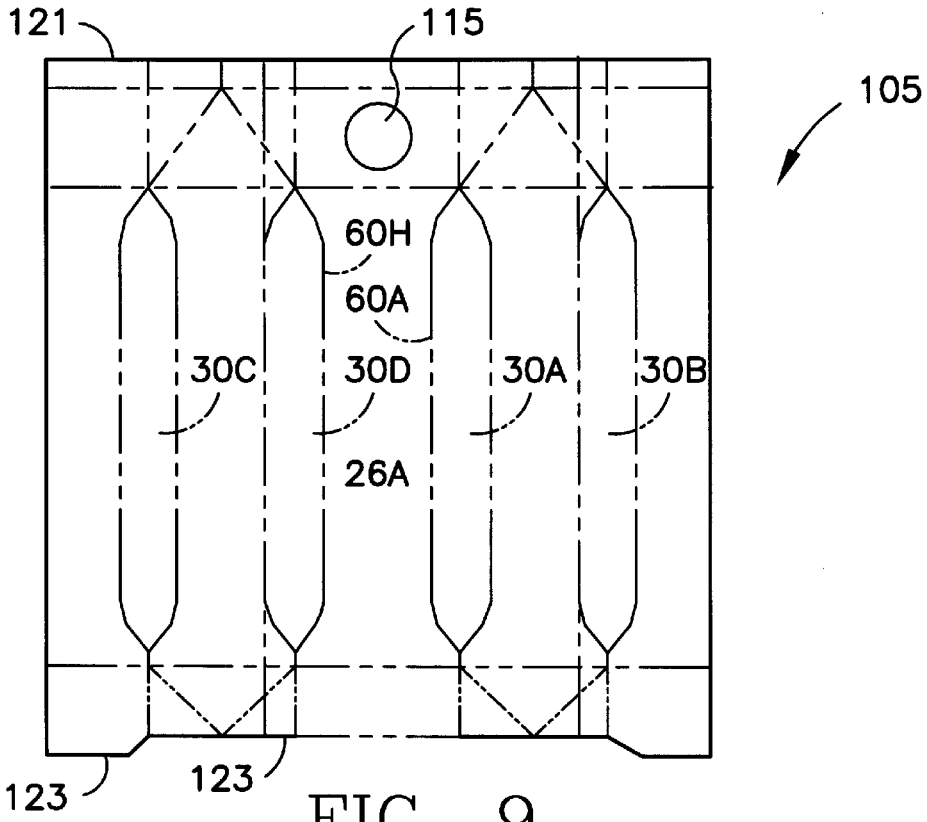
Figure 10:
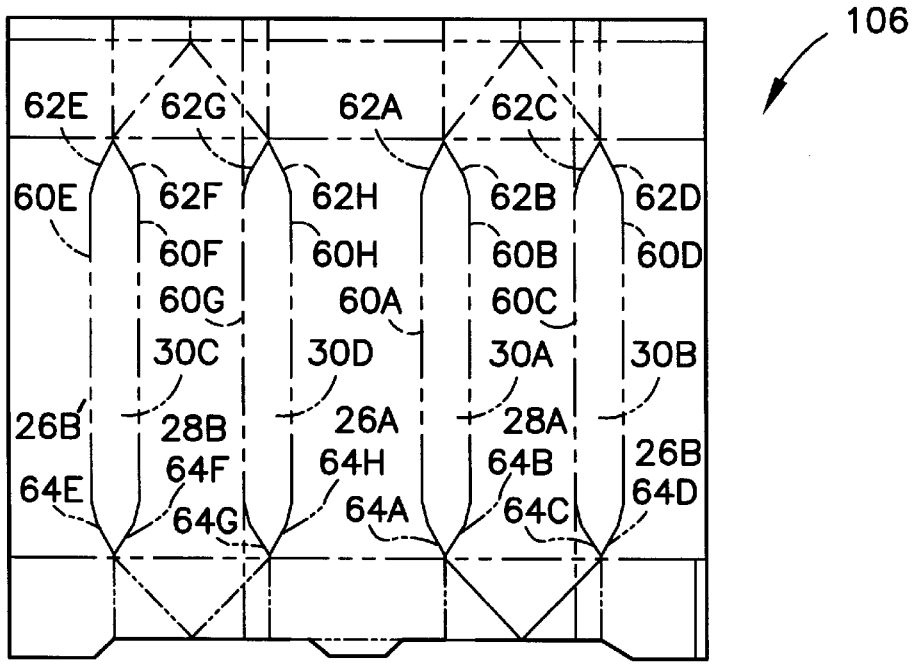
Figure 11:
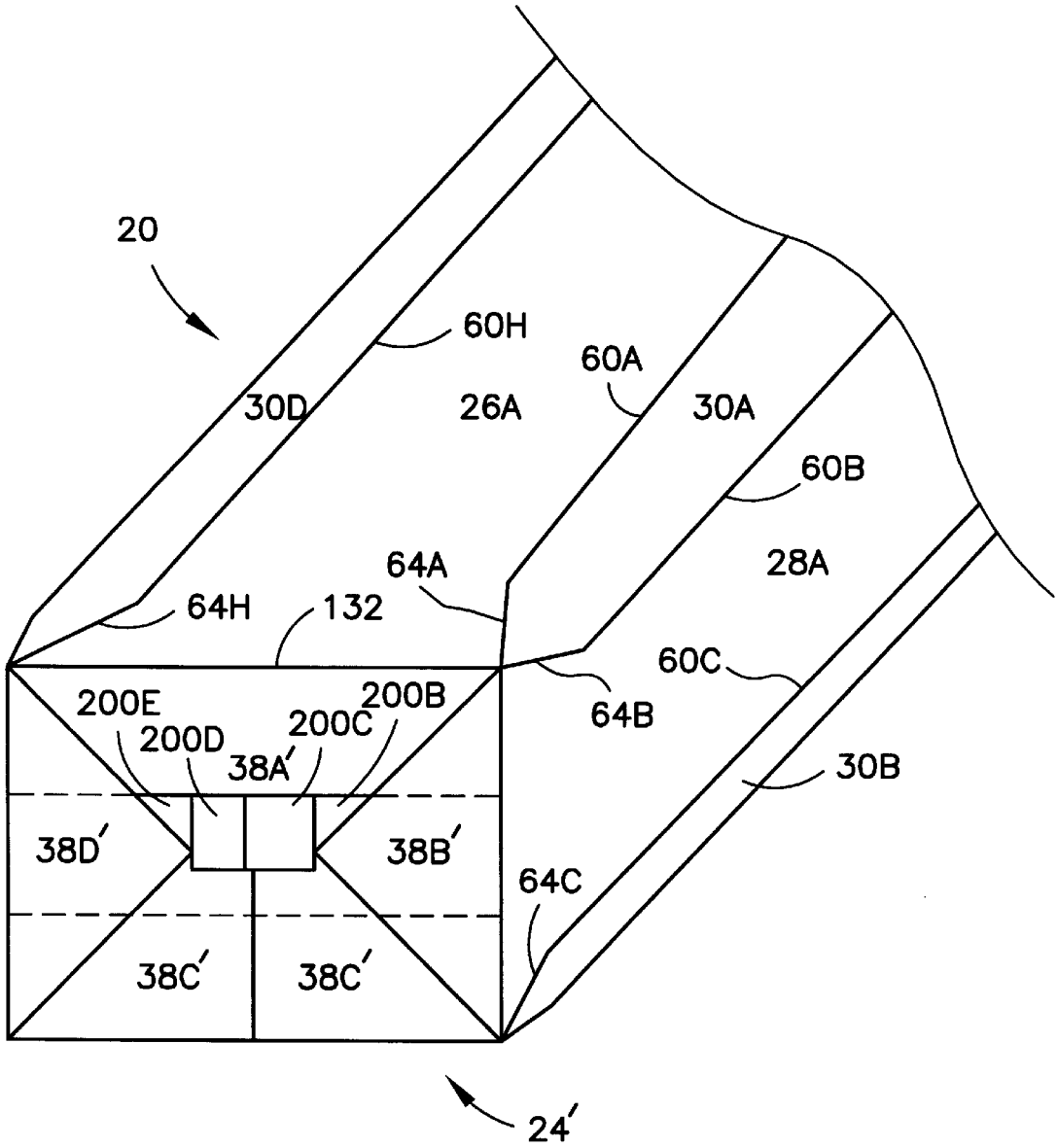
Figure 12:
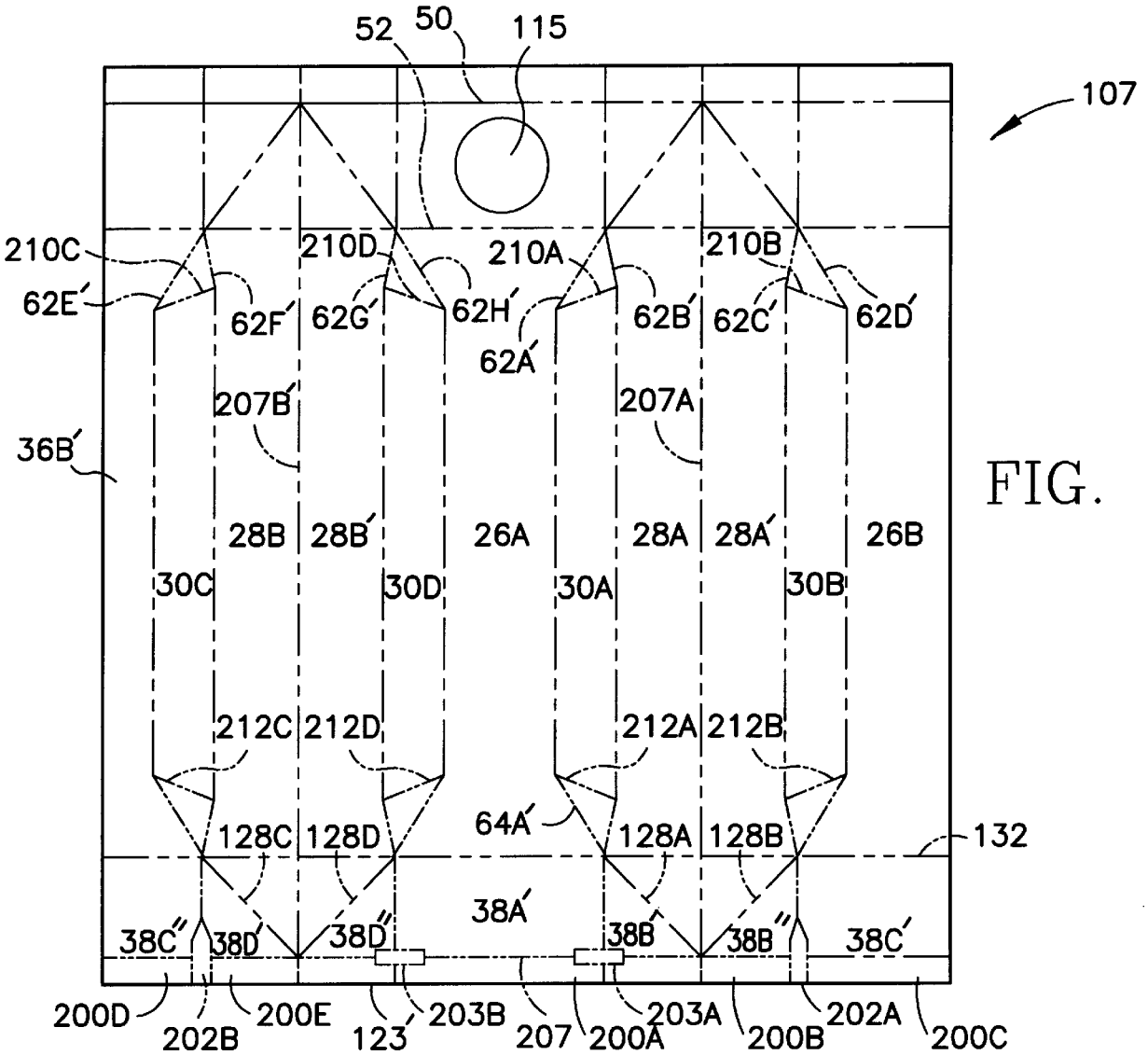
Figure 13:
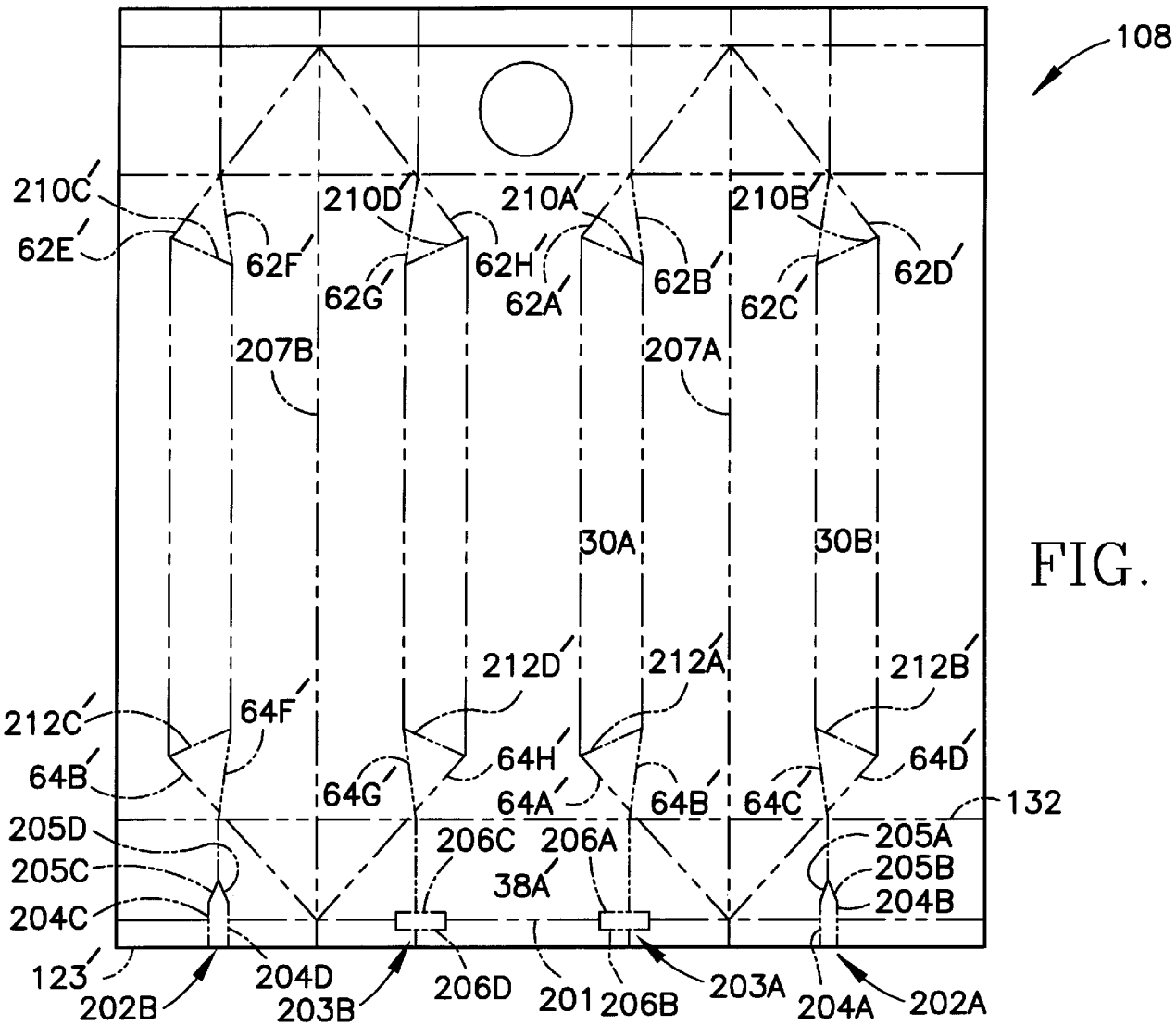
Figure 14:
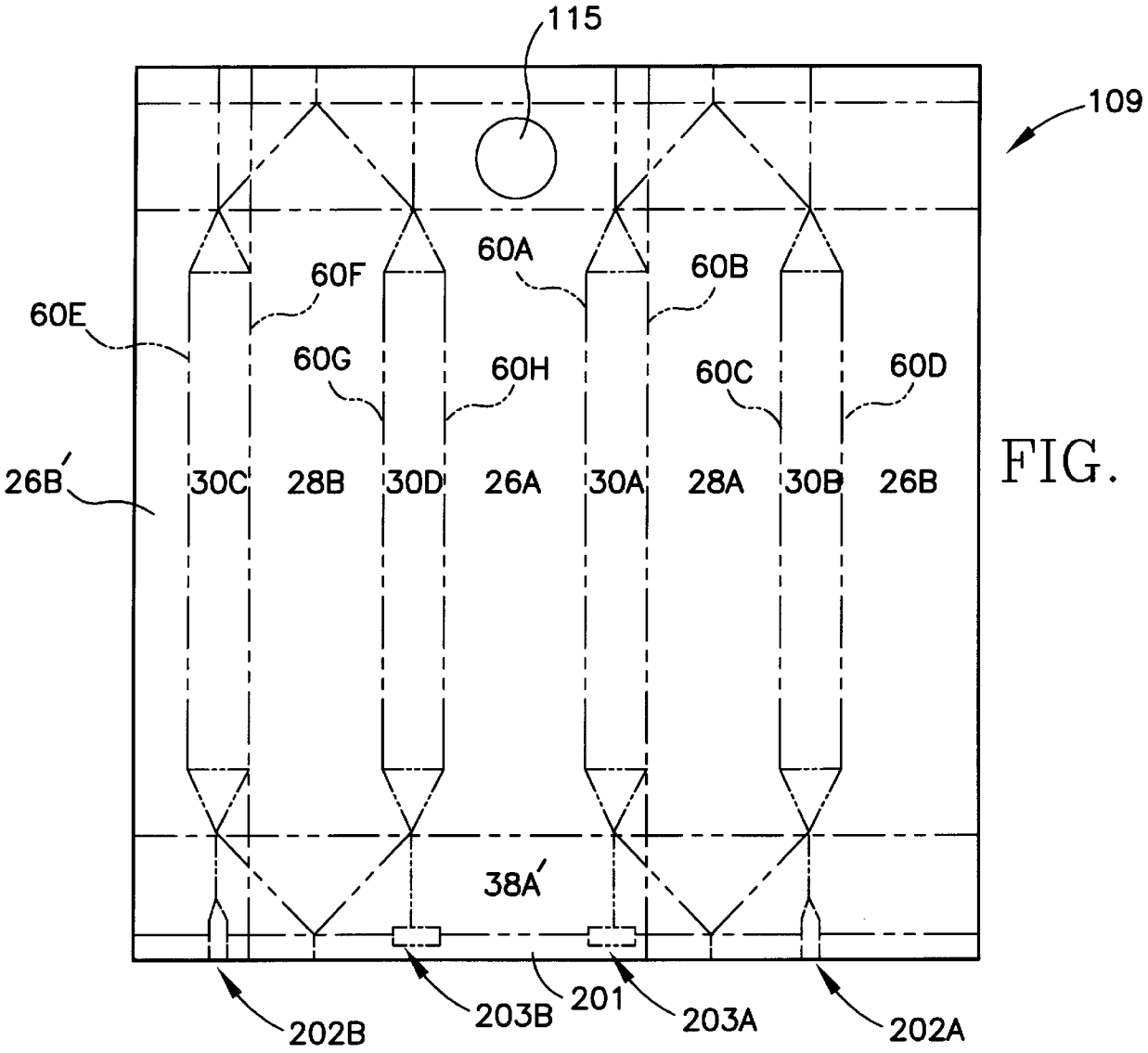
Figure 15:
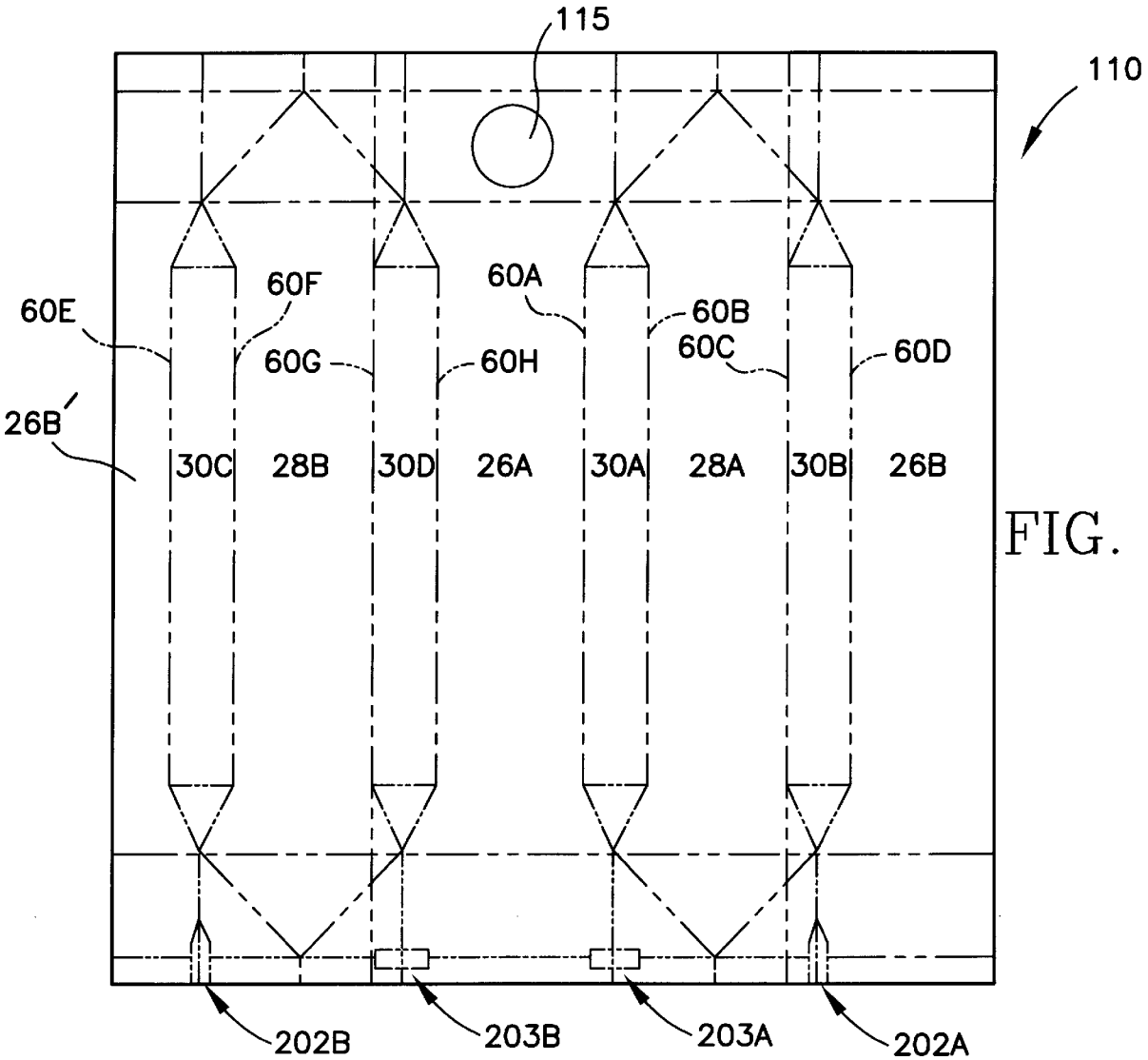
Figure 16:
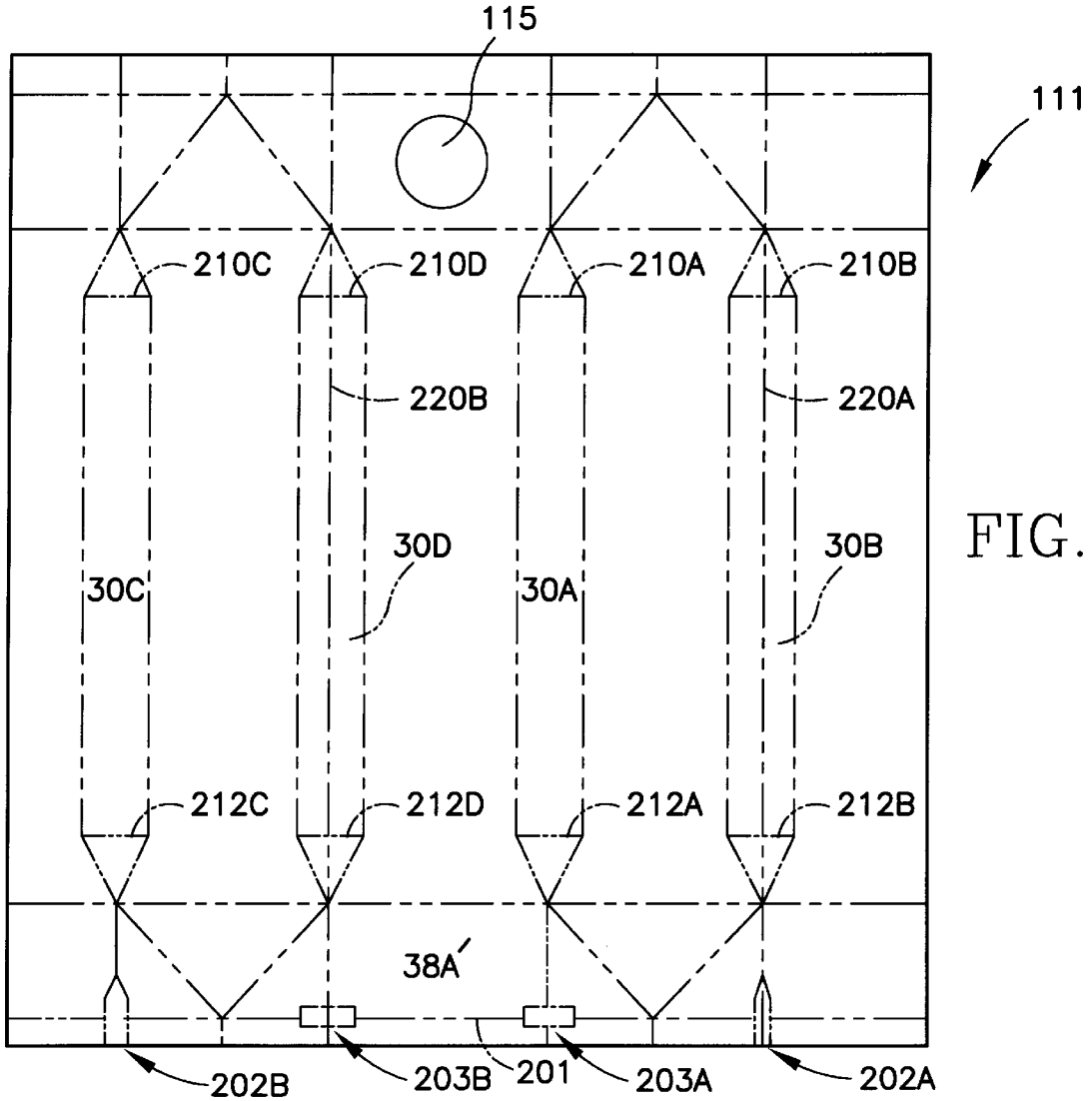

There is illustrated in FIG. 2 a front view of the carton of FIG. 1;

There is illustrated in FIG. 3 a side view of the carton of FIG. 1;

There is illustrated in FIG. 4 a plan view of a preferred embodiment of a blank of the present invention;

There is illustrated in FIG. 4A an enlarged view of enclosure A of FIG. 4;

There is illustrated in FIG. 4B an enlarged view of enclosure B of FIG. 4;

There is illustrated in FIG. 4C an enlarged view of enclosure C of FIG. 4;

There is illustrated in FIG. 4D an enlarged view of enclosure D of FIG. 4;

There is illustrated in FIG. 5 a plan view of an alternative embodiment of a blank of the present invention;

There is illustrated in FIG. 6 a plan view of an alternative embodiment of a blank of the present invention;

There is illustrated in FIG. 7 a plan view of an alternative embodiment of a blank of the present invention;

There is illustrated in FIG. 8 a plan view of an alternative embodiment of a blank of the present invention;

There is illustrated in FIG. 9 a plan view of an alternative embodiment of a blank of the present invention;

There is illustrated in FIG. 10 a plan view of an alternative embodiment of a blank of the present invention;

There is illustrated in FIG. 11 a bottom perspective view of a carton of the present invention with an overfolded bottom;

There is illustrated in FIG. 12 a plan view of an alternative embodiment of a blank of the present invention for fabricating a carton of the present invention with an overfolded bottom;

There is illustrated in FIG. 13 a plan view of an alternative embodiment of a blank of the present invention for fabricating a carton of the present invention with an overfolded bottom;

There is illustrated in FIG. 14 a plan view of an alternative embodiment of a blank of the present invention for fabricating a carton of the present invention with an overfolded bottom;

There is illustrated in FIG. 15 a plan view of an alternative embodiment of a blank of the present invention for fabricating a carton of the present invention with an overfolded bottom;

There is illustrated in FIG. 16 a plan view of an alternative embodiment of a blank of the present invention for fabricating a carton of the present invention with an overfolded bottom.

DETAILED DESCRIPTION OF THE INVENTION

As shown in FIGS. 1–3, a carton 20 is generally includes a top section 22, a bottom section 24, side panels 26A–B (side panel 26B is not shown), side panels 28A (side panel 28B is not shown), beveled edges 30A–D (beveled edge 30C is not shown), and a fitment 32. The carton 20 may be a composed of a fiberboard material which may be coated with a thermoplastic material such as polyethylene ("PE") or polyethylene terephthalate ("PET"). A barrier layer may be included in the composition of the material depending on the product contained within the carton 20.

The top section may be a gable top as shown in FIGS. 1–3, or alternatively the top section 22 may have a different shape such as flat or tetrahedral as described in copending U.S. patent application Ser. No. 08/911,448 for a Tetrahedral Top Carton which relevant parts are hereby incorporated by reference. The gable top section 22 as shown in FIGS. 1–3 has a top fin 34 and top panels 36A–D (top panel 36D is not shown). The top fin 34 is separated from the top panels 36A–D by a horizontal fin score line 50. The top panels 36A–D are separated from the side panels 26A–B and 28A–B by an upper horizontal score line 52. The top panels 36A–D and top fin 34 are folded together on a linear form, fill and seal packaging machine such as a TETRA REX® packaging machine available from Tetra Pak, Inc. of Chicago, Ill. The fitment 32 is disposed on the top panel 36A to permit resealable access to the product contained within the carton 20. The fitment 32 may be a flip-cap type fitment, a screw cap type fitment or a plunger type fitment. The fitment 32 may be applied before or after filling of the carton 20, and the fitment may be applied through ultrasonic means, hot melt means, heat sealing, or the like.

The beveled edges 30A–D are located at the intersection of the side panels 26A–B and 28A–B. More precisely, beveled edge 30A is the intersection of side panels 26A and 28A, beveled edge 30B is the intersection of side panels 26B and 28A, beveled edge 30C is the intersection of side panels 26B and 28B, and beveled edge 30D is the intersection of side panels 26A and 28B. As described below in reference to the various blanks, the beveled edges 30A–D are formed from score or crease lines which are inscribed on the blank while in web form. Each corresponding pair of a plurality of beveled edge vertical score lines 60A–H define the width "W" of the beveled edges 30A–D. For example, the pair of beveled edge vertical score lines 60A–B define the width of the beveled edge 30A. In the carton shown in FIGS. 1–3, the plurality of beveled edge vertical score lines 60A–H extend along the entire length of the carton 20 from the bottom section 24 to the fin 34. However, in other embodiments which are described below in reference to the blanks, the plurality of beveled edge vertical score lines 60A–H may only extend along a majority of the longitudinal length of the side panels 26A–B and 28A–B. In other embodiments, the plurality of beveled edge vertical score lines 60A–H may only have one or two beveled edge vertical score lines extending along the entire vertical length of the carton 20. The plurality of beveled edge vertical score lines 60A–H assists in the in the fabrication of the beveled edge carton 20 allowing for facilitated folding of the blank to form the carton 20. For clarity, "vertical" and "longitudinal" as used herein refer to the carton resting on its bottom section with a central longitudinal/vertical axis extending from the top fin 34 through the center of the carton 20 to the bottom section 24. Consequently, any use of "horizontal" or "latitudinal" refers to the perpendicular or substantially perpendicular to the vertical axis.

A plurality of beveled edge upper diagonal score lines 62A–H and a plurality of beveled edge lower diagonal score lines 64A–H define the width of each of the corresponding beveled edges 30A–D near the top and bottom of the side panels 26A–B and 28A–B. In this embodiment, each pair of beveled edge upper and lower diagonal score lines 62A–H and 64A–H meet to at an upper beveled edge apex 66A–D or lower beveled edge apex 68A–D respectively. For example, upper diagonal score lines 62A–B meet at upper beveled edge apex 66A. The beveled edge upper and lower diagonal score lines 62A–H and 64A–H assists in the transition from the beveled edge 30A–D to top or bottom sections 22 and 24, and assists in the fabrication of the beveled edge carton 20 allowing for facilitated folding of the blank to form the carton 20.

FIGS. 4–10 and 12–16 illustrate various embodiments of blanks 100–111 of the present invention. Similar references for each of the blanks 100–111 will utilize similar designations, and designations made in reference to the carton of FIGS. 1–3. The carton blank 100 of FIG. 4 is fabricated into the carton of FIGS. 1–3. The carton 20 formed from the blank 100 is a one liter volume carton with a 75 mm×65 mm cross-section. However, cartons and blanks therefore with different volumes and different cross-sections are well within the scope and spirit of the present invention. The general structure of the blanks 100–111 include a plurality of side panels 26A–B,B' and 28A–B, a plurality of top panels 36A–D, C', a plurality of bottom panels 38A–D, C', top fin panels 34A–D, B'–D', and the beveled edges 30A–D which are in fact the intersections of the side panels 26A–B and 28A–B. Variations on this basic structure include the presence or absence of an aperture 115 for placement of a fitment thereabout, bottom fin panels 200A–D,B'–D' (FIGS. 12–16) and a sixth panel 40 (FIGS. 5–7 and 10). A fitment 32 may be placed through the aperture 115 of a partially formed carton 20, attached to the exterior of a filled and sealed carton 20, or applied prior to forming of the carton 20. If the fitment 32 is applied to the exterior of a carton 20, then a membrane may be present over the aperture 115. The panels of the blanks 100–111 are defined and separated from each other by a series of score/crease lines which determine the folding and ultimate configuration of the carton 20.

A plurality of upper apex vertical score lines 120A–D originate at the upper apices 66A–D and extend to the upper edge 121 of the blank. A plurality of lower apex vertical score lines 122A–D originate at the lower apices 68A–D and extend to the lower edge 123 of the blank. A plurality of top panel diagonal score lines 124A–D extend from upper horizontal score line 52 to horizontal fin score line 50 forming a top panel apices 125A–B thereat. A plurality of fin vertical score lines 126A–B extend for respective apices 125A–B to the upper edge 121. The top panel diagonal score lines 124A–D assist in defining the gable top structure of the top section 22, and in embodiments without a fitment 32, the top panel diagonal score lines 124A–D define an access means for accessing the product contained within the carton 20. This access actuated by tearing open the top section 22 to form a traditional gable top pouring spout.

A plurality of bottom panel diagonal score lines 128A–D extend from a bottom panel horizontal score line 132 to the lower edge 123. At the lower edge 123, the diagonal score lines 128A–D respectively form bottom panel apices 130A–B. The embodiment of blanks 100–106, shown in FIGS. 4–10, will have bottom panels 38C and 38C' folded over bottom panel 38A which is folded over bottom panels 38B and 38D. Sixth panel 40 is also folded under panels 38C and 38C'.

The various exploded views of FIG. 4, shown in FIGS. 4A–D, illustrate the intersection of the various score lines. Of note, is FIG. 4B which illustrates the apices 66C and 66D below the horizontal score line 52.

Focusing on the variations of each of the embodiments of the blanks 100–111, the blank 100 of FIG. 4 will be utilized as a basis of comparison. The blank 100 of FIG. 4 is fabricated into an one liter volume carton having a rectangular cross-section, and having a fitment for accessing the product contained therein. The blank 101 of FIG. 5 is also fabricated into an one liter volume carton having a rectangular cross-section with a fitment thereon. However, the blank 101 only has two beveled edge vertical score lines 60C and 60G which extend along the entire length of the blank 101. The other beveled edge vertical score lines 60A–B, 60D–F and 60H only extend along a majority of the longitudinal length of their respective side panels 26A–B and 28A–B. The beveled edge vertical score lines 60A–B, 60D–F and 60H terminate at their respective upper and lower beveled edge diagonal score lines 62 and 64.

The blank 102 of FIG. 6 is also fabricated into an one liter volume carton having a rectangular cross-section, 75 mm×65 mm. However, the blank 102 does not have an aperture 115 for a fitment. Thus, as mentioned above, the top section 22 of the eventual carton 20 fabricated from the blank 102 is torn open at the sides to create a pour spout. Top panel diagonal score lines 124C–D or 124A–B define the pour spout. As with the blank 100, blank 102 has all of the beveled edge vertical score lines 60A–H extending the entire length of the blank 102.

The blank 103 of FIG. 7 is also fabricated into an one liter volume carton with a fitment 32 thereon. However, the eventual carton 20 of the blank 103 has a square cross-section, 70 mm×70 mm. The beveled edges 30A–D of the blank 103 and the blank 100 have 26 mm width, "W", and a 20 mm radius once formed. The difference in blanks 100 and 103 arise from the longitudinal length "L" and the width of each of the side panels 26A–B and 28A–B. The length of blank 100 is approximately 181.5 mm from the bottom horizontal score line 132 to the top horizontal score line 52. The length of blank 103 is approximately 182.0 mm from the bottom horizontal score line 132 to the top horizontal score line 52. The width of side panel 26A of the blank 100 from beveled edge vertical score line 60A to beveled edge vertical score line 60H is approximately 49 mm while the width of side panel 26A of the blank 103 beveled edge vertical score line 60A to beveled edge vertical score line 60H is approximately 46 mm. The width of side panel 28A of the blank 100 from beveled edge vertical score line 60B to beveled edge vertical score line 60C is approximately 39 mm while the width of side panel 28A of the blank 103 beveled edge vertical score line 60B to beveled edge vertical score line 60C is approximately 42 mm.

The blank 104 of FIG. 8 is also fabricated into an one liter volume carton having a rectangular cross-section, 75 mm×65 mm. However, the blank 104 has an aperture 115' for a fitment located on top panel 36D and side panel 28B. There is also center horizontal score lines 150A–B which along with top diagonal score lines and upper beveled edge diagonal score lines, define the folding around the fitment aperture 115' and its opposing side on a fabricated carton.

The blank 105 of FIG. 9 is also fabricated into an one liter volume carton, however it has a square cross-section, 66 mm×66 mm. The length of the blank 105 from lower edge 123 to upper edge 121 is 299.2 mm. The width of panel 26A from beveled edge vertical score line 60A to beveled edge vertical score line 60H is approximately 40 mm. The width W of each of the beveled edges 30A–D is 26 mm.

The blank 106 of FIG. 10 is also fabricated into an one liter volume carton having a rectangular cross-section with a fitment thereon. However, the blank 106 only has two beveled edge vertical score lines 60C and 60G which extend along the entire length of the blank 106. The other beveled edge vertical score lines 60A–B, 60D–F and 60H only extend along a majority of the longitudinal length of their respective side panels 26A–B and 28A–B. The beveled edge vertical score lines 60A–B, 60D–F and 60H terminate at their respective upper and lower beveled edge diagonal score lines 62 and 64.

There is illustrated in FIG. 11 a variation of the bottom section 24 of the carton 20 of the present invention. The bottom section 24' of FIG. 11 is an overfolded bottom as opposed to a traditional bottom for a gable top carton. As shown, the bottom panels 38B' and 38D' are folded over bottom panels 38C' and 38C", and corresponding bottom fin panels 200C–D which are folded over bottom panel 38A'. The bottom section 24' is embodied in blanks 107–111 which are shown in FIGS. 12–16 and described below.

Blanks 107–111 all have bottom fin panels 200A–E which assists in the bottom sealing to prevent leakage of the product through the bottom section and to prevent wicking. The bottom fin panels are separated from the bottom panels 38A'–D" by a bottom fin horizontal score line 201. A first and second longitudinal overfolded bottom series of score lines 202A–B, and a first and second latitudinal overfolded bottom series of score lines 203A–B assists in folding the overfolded bottom section 24' illustrated in FIG. 11. Each of the longitudinal overfolded bottom series of score lines 202A–B are composed of a pair of longitudinal parallel score lines 204A–D and a pair of longitudinal diagonal score lines 205A–D. Each of the latitudinal overfolded bottom series of score lines 203A–B are composed of a pair of latitudinal parallel lines 206A–D. Blanks 107–111 also have a pair of center vertical score lines 207A–B located in the center of panels 28A and 28B thereby dividing the panels into 28A and 28A' and 28B and 28B'.

Blanks 107 and 108, of FIGS. 12 and 13 respectively, are very similar with only a slight distinction. The upper and lower beveled edge diagonal score lines 62A'–H' and 64A'–H' are offset and asymmetrical in comparison to those of the other embodiments.

Each pair of the upper beveled edge diagonal score lines 62A'–H' are connected by a corresponding beveled edge upper horizontal score lines 210A–D. Each pair of the lower beveled edge diagonal score lines 64A'–H' are connected by a corresponding beveled edge lower horizontal score lines 212A–D. On the blank 107 of FIG. 12, the upper horizontal score lines 210A–D are inclined, while on the blank 108 of FIG. 13, the upper horizontal score lines 210A'–D' are declined. On the blank 107 of FIG. 12, the lower horizontal score lines 212A–D are declined, while on the blank 108 of FIG. 13, the lower horizontal score lines 212A'–D' are inclined.

The blank 109 of FIG. 14 only has two beveled edge vertical score lines 60B and 60F which extend along the entire length of the blank 109. The other beveled edge vertical score lines 60A, 60C–E and 60G–H only extend along a majority of the longitudinal length of their respective side panels 26A–B and 28A–B. The beveled edge vertical score lines 60A, 60C–E and 60G–H terminate at their respective upper and lower beveled edge diagonal score lines 62 and 64.

The blank 110 of FIG. 15 only has two beveled edge vertical score lines 60C and 60G which extend along the entire length of the blank 110. The other beveled edge vertical score lines 60A–B, 60D–F and 60H only extend along a majority of the longitudinal length of their respective side panels 26A–B and 28A–B. The beveled edge vertical score lines 60A–B, 60D–F and 60H terminate at their respective upper and lower beveled edge diagonal score lines 62 and 64.

The blank 111 of FIG. 16 has center beveled edge vertical score lines 220A–B which divide the beveled edges 30B and 30D, extending along the entire longitudinal length of the blank 111. None of the beveled edge vertical score lines 60A–H extend along the entire length of the blank 111.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A blank for forming a carton having beveled edges, the blank comprising:

a plurality of side panels, each of the plurality of side panels meeting an adjacent side at an intersection of adjacent side panels;

a plurality of top panels, each of the plurality of top panels corresponding to a side panel;

a plurality of bottom panels, each of the plurality of bottom panels corresponding to a side panel; and a plurality of pairs of beveled edge vertical score lines, each pair of beveled edge vertical score lines defining each of the intersections of adjacent side panels, each of the beveled vertical score lines extending along the entire length of the blank.

2. The blank according to claim 1 wherein the plurality of bottom panels comprises:

first, second, third, fourth and fifth bottom panels, the second and fourth bottom panels each having a pair of lower diagonal score lines;

a first longitudinal folded over bottom series of score lines and a second longitudinal overfolded bottom series of score lines; and a first latitudinal overfolded bottom series of score lines and a second latitudinal folded over bottom series of score lines;

whereby the overfolded bottom series of score lines allow for the folding of the second and fourth bottom panels over the first, third and fifth bottom panels.

3. The blank according to claim 1 further comprising:

a plurality of upper horizontal score lines separating the top panels from each of the corresponding side panels; and a plurality of pairs of upper beveled edge diagonal score lines, each pair of upper beveled edge diagonal score lines meeting to form an apex substantially near a corresponding upper horizontal score line at an apex end, each upper beveled edge diagonal score lines intersecting at a non-apex end with a corresponding beveled edge vertical score line.

4. A carton made from the blank according to claim 1, the carton for containing a flowable material, the carton comprising:

a top section having means for accessing the flowable material;

a bottom section opposite the top section along the length of the carton;

the plurality of side panels extending between the top and bottom sections; and a plurality of beveled edges at each intersection of adjacent side panels.

5. The carton according to claim 4 wherein the access means is a fitment.

6. A blank for forming a carton having beveled edges, the blank comprising:

a plurality of side panels, each of the plurality of side panels meeting an adjacent side panel at an intersection of adjacent side panels;

a plurality of top panels, each of the plurality of top panels corresponding to a side panel;

a plurality of bottom panels, each of the plurality of bottom panels corresponding to a side panel; and a plurality of pairs of beveled edge vertical score lines, each pair of beveled edge vertical score lines defining each of the intersections, wherein at least one beveled edge vertical score line of each of a first and a third pairs of the plurality of pairs of beveled edge vertical score lines extends the entire length of the blank.

7. A carton made from the blank according to claim 6, the carton for containing a flowable material, the carton comprising:

a top section having means for accessing the flowable material;

a bottom section opposite the top section along the length of the carton;

the plurality of side panels extending between the top and bottom sections; and a plurality of beveled edges at each intersection of adjacent side panels.

8. A blank for forming a carton having beveled edges, the blank comprising:

a plurality of side panels, each of the plurality of side panels meeting an adjacent side panel at an intersection of adjacent side panels;

a plurality of top panels, each of the plurality of top panels corresponding to a side panel;

a plurality of bottom panels, each of the plurality of bottom panels corresponding to a side panel; and a plurality of pairs of beveled edge vertical score lines, each pair of beveled edge vertical score lines defining each of the intersections, wherein at least one beveled edge vertical score line of each of a second and a fourth pairs of the plurality of pairs of beveled edge vertical score lines extends the entire length of the blank.

9. A carton made from the blank according to claim 8, the carton for containing a flowable material, the carton comprising:

a top section having means for accessing the flowable material;

a bottom section opposite the top section along the length of the carton;

the plurality of side panels extending between the top and bottom sections; and a plurality of beveled edges at each intersection of adjacent side panels.

10. A blank for a carton having beveled edges, the blank comprising:

first, second, third, fourth and fifth side panels, each of the side panels meeting an adjacent side panel at an intersection of adjacent side panels;

a first pair of beveled edge vertical score lines defining the intersection of the first and second side panels, a second pair of beveled edge vertical score lines defining the intersection of the second and third side panels, a third pair of beveled edge vertical score lines defining the intersection of the third and fourth side panels, and a fourth pair of beveled edge vertical score lines defining the intersection of the fourth and fifth side panels, each of the beveled edge vertical score lines extending along the majority of the length of the corresponding side panels first, second, third, fourth and fifth top panels, each of the top panels adjacent a corresponding side panel, each of the top panels separated from the corresponding side panels by a plurality of upper horizontal score lines; and a plurality of pairs of upper beveled edge diagonal score lines, each pair of upper beveled edge diagonal score lines meeting to form an apex substantially near a corresponding upper horizontal score line.

11. The blank according to claim 10 further comprising:

first, second, third, fourth and fifth top panels, each of the top panels adjacent a corresponding side panel, each of the top panels separated from the corresponding side panels by a plurality of upper horizontal score lines;

a plurality of pairs of upper beveled edge diagonal score lines, each pair of upper beveled edge diagonal score lines meeting to form an apex substantially near a corresponding upper horizontal score line.

12. The blank according to claim 10 further comprising:

first, second, third, fourth and fifth bottom panels, each of the bottom panels adjacent a corresponding side panel, each of the bottom panels separated from the corresponding side panels by a plurality of lower horizontal score lines;

a plurality of pairs of lower beveled edge diagonal score lines, each pair of lower beveled edge diagonal score lines meeting to form an apex substantially near a corresponding lower horizontal score line.

13. The blank according to claim 10 further comprising:

first, second, third, fourth and fifth bottom panels, each of the bottom panels adjacent a corresponding side panel, each of the bottom panels separated from the corresponding side panels by a plurality of lower horizontal score lines, the second and fourth bottom panels each having a pair of lower diagonal score lines;

a first longitudinal folded over bottom series of score lines and a second longitudinal overfolded bottom series of score lines;

a first latitudinal overfolded bottom series of score lines and a second latitudinal folded over bottom series of score lines;

whereby the overfolded bottom series of score lines allow for the folding of the second and fourth bottom panels over the first, third and fifth bottom panels.

14. The blank according to claim 10 further comprising an aperture for placement of a fitment therethrough.

15. The blank according to claim 10 wherein at least one beveled edge vertical score line of each of the first and third pairs of beveled edge vertical score lines extends the entire length of the blank.

16. The blank according to claim 10 wherein at least one beveled edge vertical score line of each of the second and fourth pairs of beveled edge vertical score lines extends the entire length of the blank.

17. The blank according to claim 10 wherein all of the beveled edge vertical score lines extend the entire length of the blank.

18. The blank according to claim 10 further comprising a first beveled edge center vertical score line disposed equidistant from each of the first pair of beveled edge vertical score lines and extending the entire length of the blank, and a second beveled edged center vertical score line disposed equidistant from each of the third pair of beveled edge vertical score lines and extending the entire length of the blank.

* * * * *